US005353844A

United States Patent [19]

Monget et al.

[11] Patent Number: 5,353,844

[45] Date of Patent: Oct. 11, 1994

[54] WARP HANDLING ARRANGEMENT FOR WEAVING A MULTI-DIMENSIONAL THICK FABRIC

[75] Inventors: Francois Monget, Merignac; Michel Hee, Castelnau du Medoc, both of France

[73] Assignee: Societe Nationale Industrielle et Aerospatiale, Paris, France

[21] Appl. No.: 61,075

[22] Filed: May 14, 1993

[30] Foreign Application Priority Data

May 15, 1992 [FR] France ..... 92 06154

[51] Int. Cl.[5] ..... D03D 13/00; D03D 41/00; D03J 1/00

[52] U.S. Cl. ..... 139/20; 139/35; 139/98

[58] Field of Search ..... 139/20, 35, 97, 98

[56] References Cited

U.S. PATENT DOCUMENTS

| | | | |
|---|---|---|---|
| 3,818,951 | 6/1974 | Greenwood | 139/35 X |
| 4,019,540 | 4/1977 | Holman et al. . | |
| 4,463,782 | 8/1984 | Borel | 139/20 X |
| 4,789,008 | 12/1988 | Kikuchi | 139/97 |
| 4,848,414 | 7/1989 | Cahuzac . | |

FOREIGN PATENT DOCUMENTS

| | | | |
|---|---|---|---|
| 0424216 | 4/1991 | European Pat. Off. . | |
| 2583072 | 12/1986 | France . | |
| 2610951 | 8/1988 | France . | |
| 141279 | 10/1930 | Switzerland | 139/35 |

*Primary Examiner*—Andrew M. Falik
*Attorney, Agent, or Firm*—Sandler, Greenblum & Bernstein

[57] ABSTRACT

A method and weaving machine for weaving a thick reinforcing fabric comprising multiple noncleaving layers with a 2.5 D or 3 D type structure. The warp yarns successively move into a yarn joining comb, a calibrating comb and then into a dobby weaving unit, where the warp yarns on n superimposed laps are separated upstream of the calibrating comb, n being equal to (N—1/2) and N being the number of layers of said reinforcement so as to have (N—1/2) warp yarns moving into each tooth of the calibrating comb. Two adjacent yarns of a given tooth of the calibrating comb are threaded into the eyes of two heddles of the same row of two heddle frames of the dobby, so that the displacement planes of two adjacent yarns during formation of the shed form between them a sufficient angle so as to prevent the yarns from catching on one another.

18 Claims, 6 Drawing Sheets

WARP HANDLING ARRANGEMENT FOR WEAVING A MULTI-DIMENSIONAL THICK FABRIC

BACKGROUND OF THE INVENTION

1. Field of the Invention

The present invention concerns the production of a woven reinforcement with multiple noncleaving layers much thicker in relation to known reinforcements of this type.

2. Discussion of Background Information

French patent application No. 87 02012 by the present assignee, which is the priority application of U.S. Pat. No. 4,848,414, describes a type of woven reinforcement with multiple noncleaving layers, and a highly resistant, e.g. very strong textile fiber base, such as glass, silica, carbon, "Kevlar", ceramic or other fibers, intended to form the reinforcements of composite materials.

This type of reinforcement is half way between reinforcement with a fibrous reinforcement piece in two directions (called 2 D) and reinforcement with a fibrous reinforcement piece in three directions (called 3 D). It is and conveniently known as a 2.5 D reinforcement, and is characterized by a structure equivalent to a noncleaving stacking of 2 D reinforcements, because the yarns of one direction, for example the warp yarns imprison the yarns, of the other direction (the weft yarns) of two adjacent layers. The term "layer" in this instance is defined by the number of superimposed parallel planes composed of the weft yarns.

As used herein the word reinforcement refers to a 2.5 D or 3 D type structure in which certain yarns, such as warp yarns, of one direction, imprison other yarns, namely the weft yarns, of the other direction of at least two layers. The number of layers is defined by the number of superimposed parallel planes composed of the weft yarns.

Thus, a noncleaving material is embodied with interlaced layers whose thickness depends on the number of layers and defined by an odd number, for example 5, 7, 9, 11, etc.

This type of woven reinforcement is produced on conventional units for weaving technical fabrics. The units include a positive dobby whose functioning is well-known. The aim of this device, by means of vertically mobile heddle frames and formed of frames bearing heddles into which the warp yarns are threaded, is to lift up or lower the warp yarns to allow for passage of the weft yarns. The warp yarns are available with the aid of a calibrating comb intended to maintain a certain warp width and regularly distribute the warp yarns over this width.

The greater the number of layers of the reinforcement, the greater the number of yarns for a given warp width. This implies increasing the number of yarns per tooth of the calibrator.

Given the fact that each yarn needs to pass into the eye of a heddle of one of the heddle frames of the dobby, the dobbies currently commercially available do not have a sufficient capacity, in terms of the number of heddle frames, to ensure a correct distribution of all the yarns. Accordingly for a number of layers equal to or greater than nine, it is impossible to make this type of reinforcement, because the yarns of a given tooth of the calibrator risk being caught up during the movements of the heddle, frames of the dobby.

SUMMARY OF THE INVENTION

The object of the present invention is to overcome this drawback by proposing a new way of presenting the warp yarns and disposing them in the weaving unit so as to allow for the weaving of reinforcements of the type defined earlier with layers equal to or greater than nine.

To this effect, the invention concerns a method for weaving a thick reinforcement with noncleaving multiple layers having a structure of type 2.5 D or 3 D in which certain warp yarns imprison the weft yarns of at least two layers, the number of layers defined by the number of superimposed parallel planes occupied by the weft yarns. Specifically, the invention concerns a weaving method and machine in which the warp yarns successively move into a yarn joining comb, a calibrating comb and then into a dobby weaving unit, wherein:

upstream of the calibrating comb, the warp yarns are separated into n superimposed laps, n being equal to (N−1,/2) and, N being the number of layers of the reinforcement so as to have (N−1/2) warp yarns pass into each tooth of of the calibrating comb, and, two adjacent yarns of a given tooth of the calibrating comb are threaded into the eyes of two heddles of the same row of two heddle frames of the dobby. The heddles of the same row are aligned along a vertical plane slanted with respect to the axis of the warp and said two heddles are selected so that the displacement planes of the two adjacent yarns, at the time the shed is formed, form between then a sufficient angle so as to avoid the yarns getting caught up with one another.

If the total number of available heddle frames is preestablished, a number of heddles shall be used equal to the product of the number of laps n by the number of teeth of the calibrating comb. This number is by default, closest to the total number of available heddle frames and, for each set of teeth, the yarns of the teeth shall be threaded onto the heddles of a given row of the heddle frames. The heddles of a given row are understood to be either the heddles placed to this effect on the heddle frames or, assuming that the heddle frames are already lined with heddles, the heddles effectively used.

Such a method allows for inexpensively using commercially available positive dobbies, for example dobbies with 28 heddle frames, by having two dobbies in series and controlling them so that the unit behaves as a single dobby with 56 heddle frames embodying the same shed as a dobby with 28 heddle frames. A or some of the heddle frames are used depending on the number of layers of the reinforcement.

BRIEF DESCRIPTION OF THE DRAWINGS

Other characteristics and advantages of the invention shall appear more readily from a reading of the following description of one embodiment of the above-mentioned method, said description being given solely by way of example with reference to the accompanying drawings on which.

DETAILED DESCRIPTION OF THE INVENTION

Figure 1:
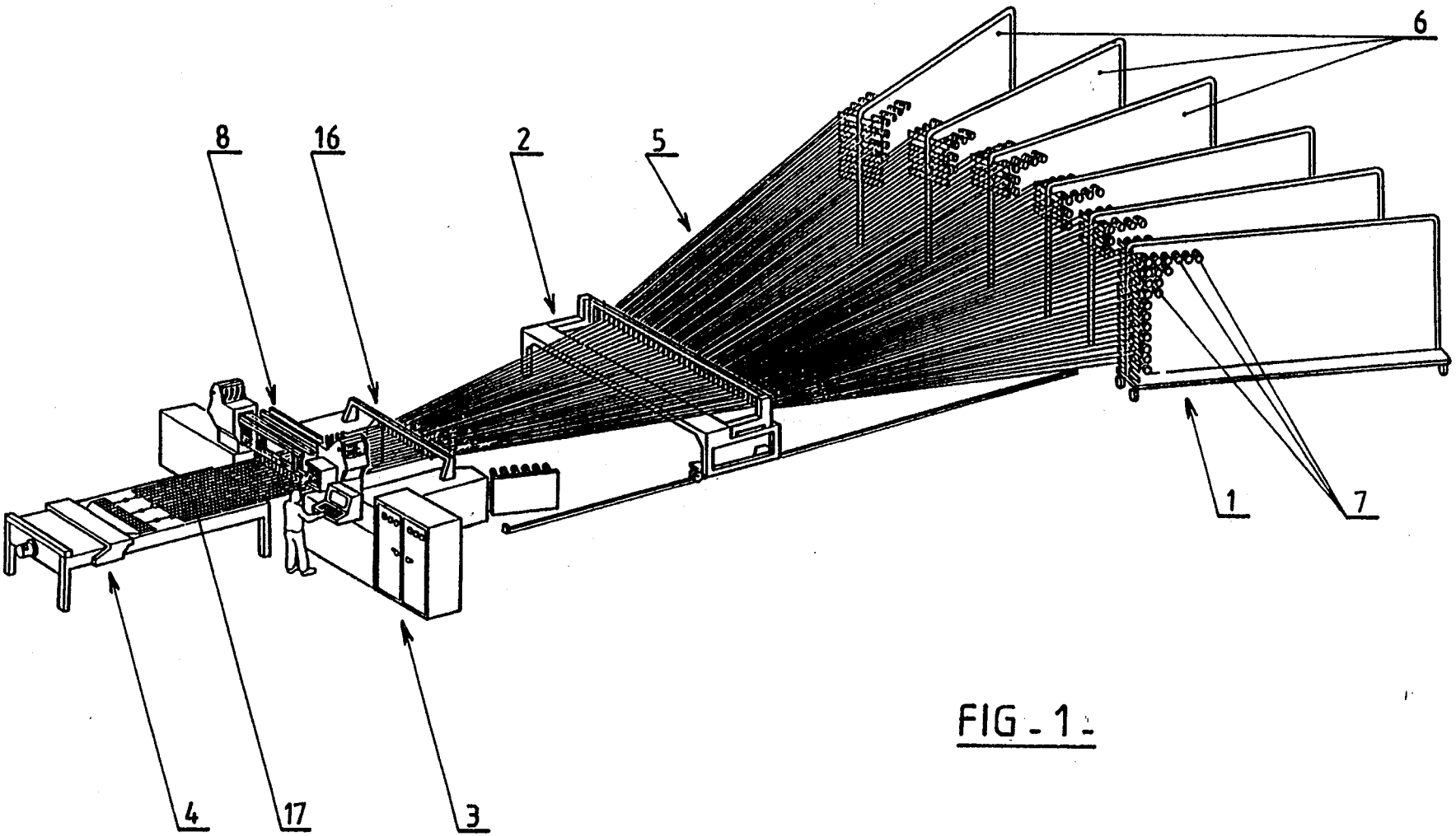
FIG. 1 is a diagrammatic perspective view of a conventional weaving machine.

FIG. 1 diagrammatically shows a known type of weaving machine including four sub-units, namely a creel 1, a yarn joining unit 2, a weaving unit 3 and a traction system.

The creel 1 supports all of the warp yarn bobbins 7 feeding the weaving unit and includes a certain number of frames. Each frame bears a certain number of bobbins 7, and is disposed fan-shaped so as to direct all the yarns towards the yarn joiner 2 all the yarns whose number of bobbins may be extremely high, for example, 10,800 as in the embodiment of the method of the invention to be described hereafter.

The yarn joiner 2 is intended to collect together the warp yarns 5, and dispose them at the front lap before they enter the weaving unit 3.

The weaving unit 3 includes a dobby 8 equipped with a certain number of vertically mobile heddle frames and formed of frames bearing heddles each intended to lift up or lower one warp yarn.

Figure 2:
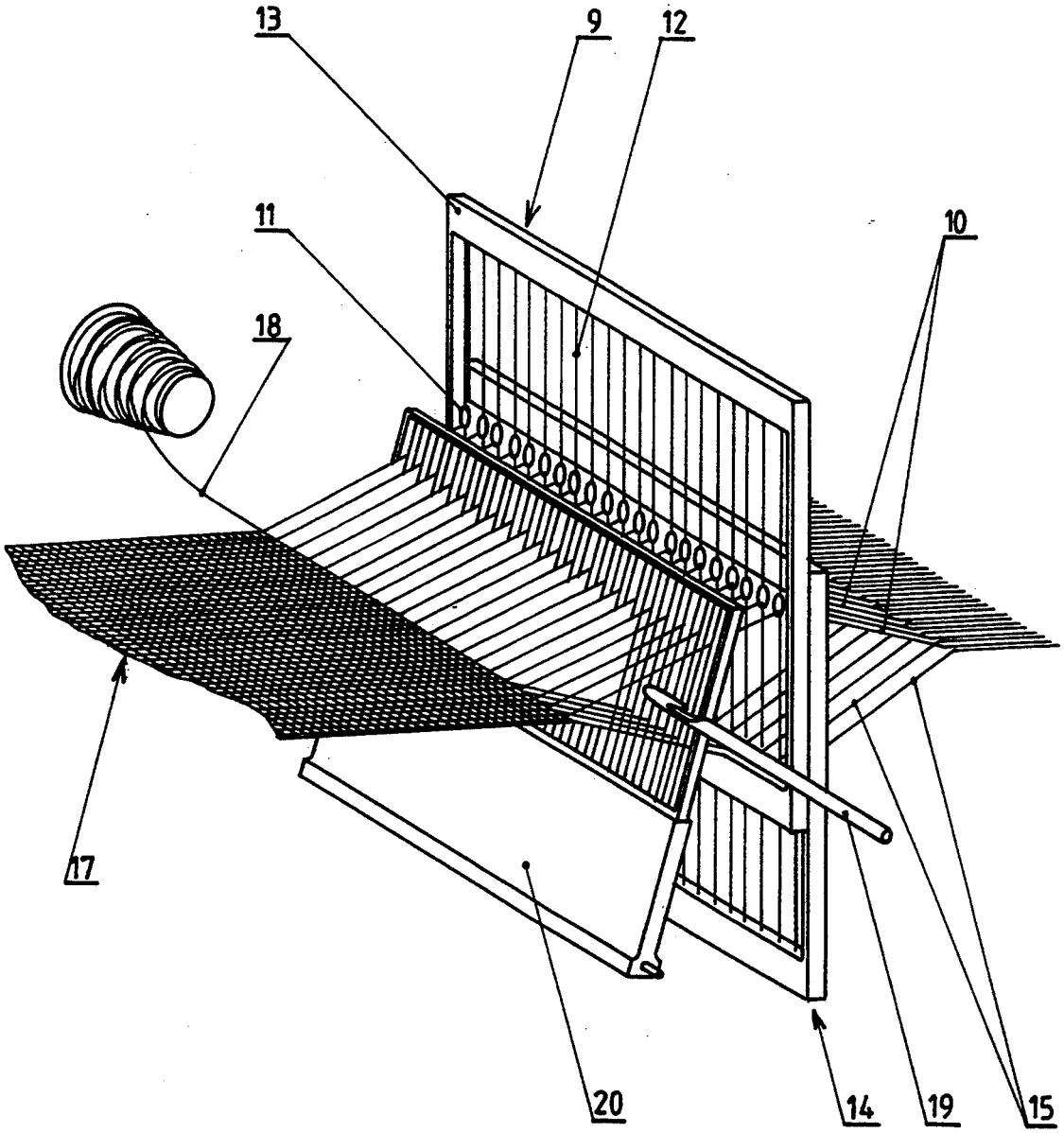
FIG. 2 is a view illustrating the operating principle of a dobby weaving unit.

FIG. 2 illustrates the well-known operating principle of such a dobby. This figure illustrates a heddle frame a in its upper position, lifting up a specific number of warp yarns 10 each threaded into one eye 11 of a heddle 12 integral with a frame 13 and, at 14, a heddle frame in its lower position, identical to the heddle frame 9 and lowering other warp yarns 15.

The spacing of two laps of yarns 10, 15 by the two heddle frames 9, 14 forms a shed opening whose range depends on the dobby, the nature of the yarns and the weaving characteristics. Upstream of the heddle frames 9, 14 (at the right on FIG. 2), the warp yarns 10, 15 are delivered by a calibrating comb 16 (FIG. 1) inserted between the dobby and the yarn joiner 2. The calibrating comb 16 is intended to calibrate the warp yarns, by distributing them uniformly over a width equal to the width of the warp 17 at the outlet of the weaving unit.

The passage of weft yarns or picks 18 is effected into the shed downstream of the heddle frames 9, 14 with the aid of a lance 19.

A sley 20 is provided for packing the pick after being inserted.

Everything which occurs downstream of the heddle frames of the dobby is well known, is not directly concerned with the invention and shall not be described further in detail.

Figure 3:
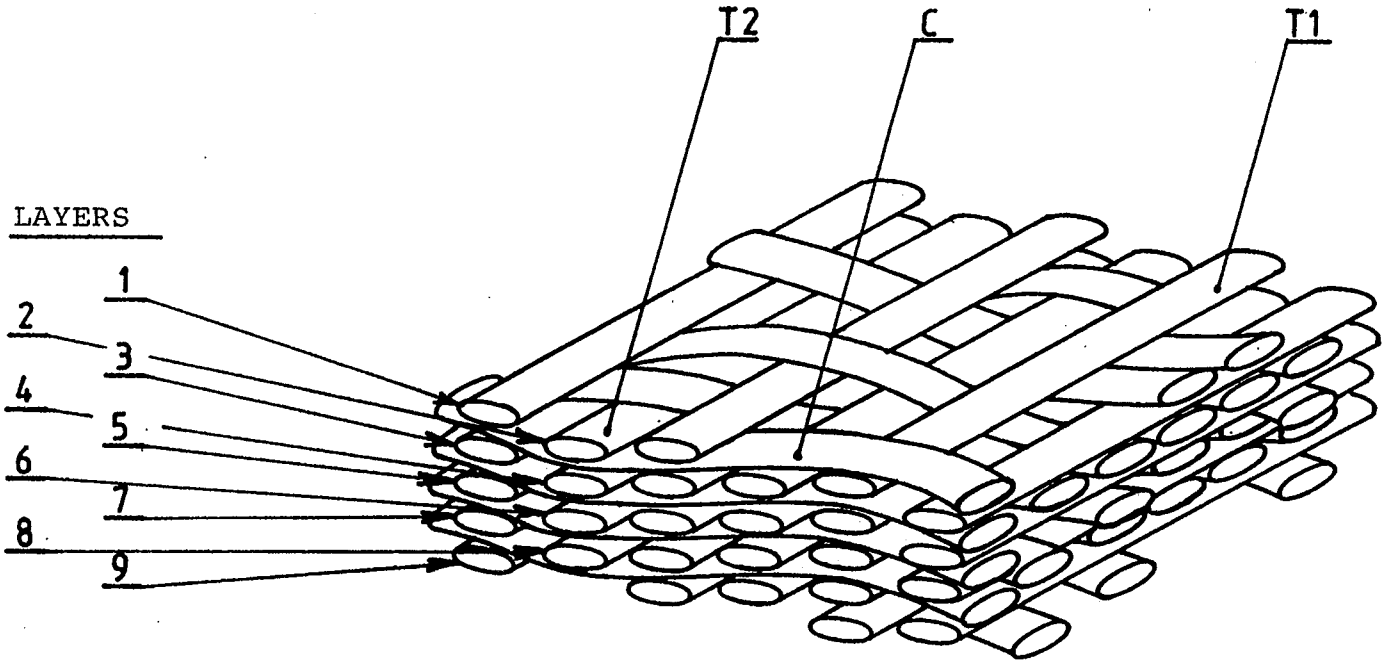
FIG. 3 is a partial cutaway perspective view of a type 2.5 D reinforcement with nine layers.

FIG. 3 illustrates a 2.5 D woven reinforcement of the type described in the French patent No 87 02012 and including nine layers numbered from 1 to 9. Each warp yarn C connects weft yarns T situated in two successive layers, for example: weft T1, layer No 1, weft T2, layer No 2.

The invention is applicable to this type of reinforcement, and the 3D type of reinforcement defined earlier, and shall now be described with reference to FIGS. 4 to 7 illustrating the preparations made to the machine of FIG. 1 for the embodiment of a woven 2.5 D reinforcement with nineteen layers.

Figure 4:
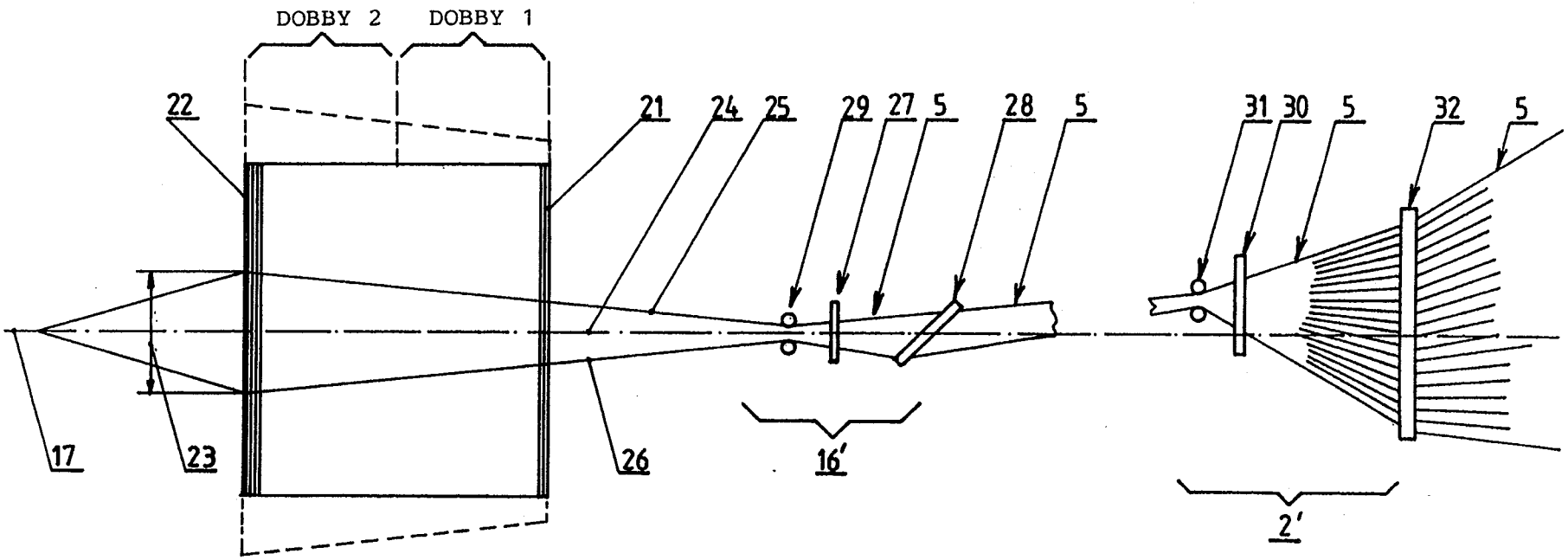
FIG. 4 is a lateral front diagrammatic view of a machine according to FIG. 1 and equipped in accordance with the invention.

In accordance with the invention, the dobby in FIG. 4 and intended for weaving of the 2.5 D reinforcement with 19 layers, comprises according to a particularly inexpensive embodiment of the invention, a side by side addition of two conventional dobbies known as dobby No 1 and dobby No 2.

Both dobbies are, for example, 2,237 type positive dobbies each equipped with 28 heddle frames and produced by the STAUBLI company.

FIG. 4 shows at 21 the first heddle frame of the dobby No 1, and at 22 the twenty-eighth heddle frame of dobby No 2.

The movement of the heddle frames of the two dobbies are controlled so as to embody a maximum shed 23, for example 260 mm, identical to the one obtained by a single dobby.

The figure shows at 24 the weaving plane (warp plane 17), and at 25 the warp yarns upstream of the dobbies in the upper position, and at 26 the warp yarns in the lowered position.

So as to embody a 2.5 D type reinforcement with 19 layers over a width of 1.5 meter, 10,800 bobbins 7 are needed and made, for example, of carbon, and mounted on the creel 1.

In accordance with the invention, the warp yarns are presented at the dobbies No 1 and 2 according to a spatial distribution introducing a special disposition of the calibrating unit 16' and a particular heddling of the yarns on the heddles of the heddle frames of the dobbies.

The calibrating unit 16 (illustrated in FIG. 4) of the invention is made up of a conventional calibrating comb 27 comprising, for example, 7.77 teeth per centimeter, with a set 28 of horizontal parallel separating bars upstream of the calibrator 27, and a pair of horizontal superimposed bars 29 for supporting and guiding the yarns downstream of the calibrator 27.

Figure 5:
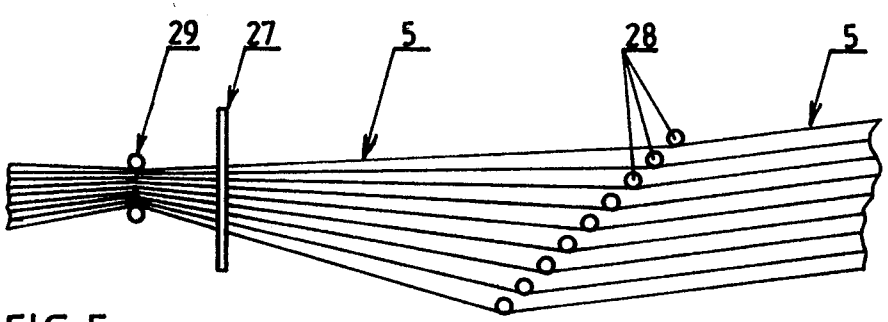
FIG. 5 is an enlarged more detailed view of the calibrating unit of the machine of FIG. 4.
Figure 6:
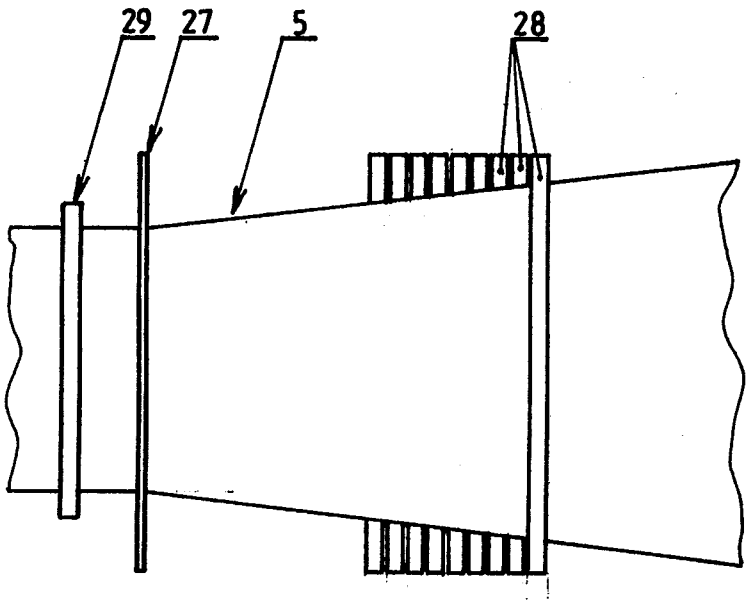
FIG. 6 is a top view of the device of FIG. 5.
Figure 7:
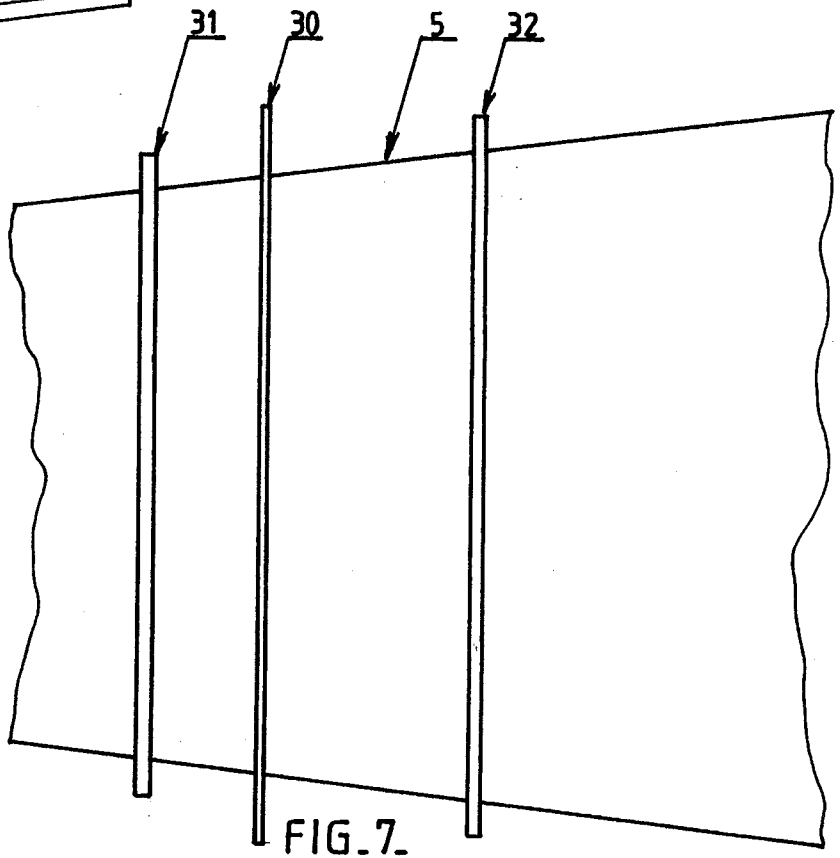
FIG. 7 is a top view of the yarn joining unit of the machine of FIG. 4.

The number of separating bars 28, shown in more detail on FIGS. 5 and 6, is equal to $(N-1/2)$, n being the number of layers of the 2.5 D reinforcement to be embodied, namely $(19-1/2)=9$, in this instance N being a positive odd integer. The bars are intended to present, at the calibrator 27, the warp yarns 5 along nine laps so as to have in each tooth of the calibrator 27 nine superimposed warp yarns, as shown on FIG. 5. The bars 28 are aligned along a slanted plane so as to reduce the angle formed by the yarn laps between the separating bars 28 and the calibrator 27.

The support and guiding bars 29 are provided for limiting the vertical clearance of the warp yarns downstream of the calibrator 27 during movements of the heddle frames of the dobbies.

The heddling of the warp yarns on the heddles of the heddle frames shall be described subsequently.

The warp yarns traversing the calibrating comb 27 originate from a yarn joining unit 2 (illustrated in FIGS. 4 and 7) which, in accordance with another characteristic of the invention, has a particular structure similar to that of the calibrating unit 16'.

This unit includes a conventional yarn joining comb 30, the number of its teeth to the centimeter being less than that of the calibrator 27. The yarns 5 occupy an equal number of teeth of the yarn joiner 30 and the calibrator 27. Yarn support and guiding bars 31 are disposed downstream of the yarn joiner 30 and, depending on the creel 1, a number of parallel horizontal separating bars 32 are disposed upstream of the yarn joiner. Given the extremely high number of yarns 5, these bars 32 are provided for channeling into superimposed laps, the yarns originating from bobbins 7 disposed at various heights on the support frames 6.

Figure 8:
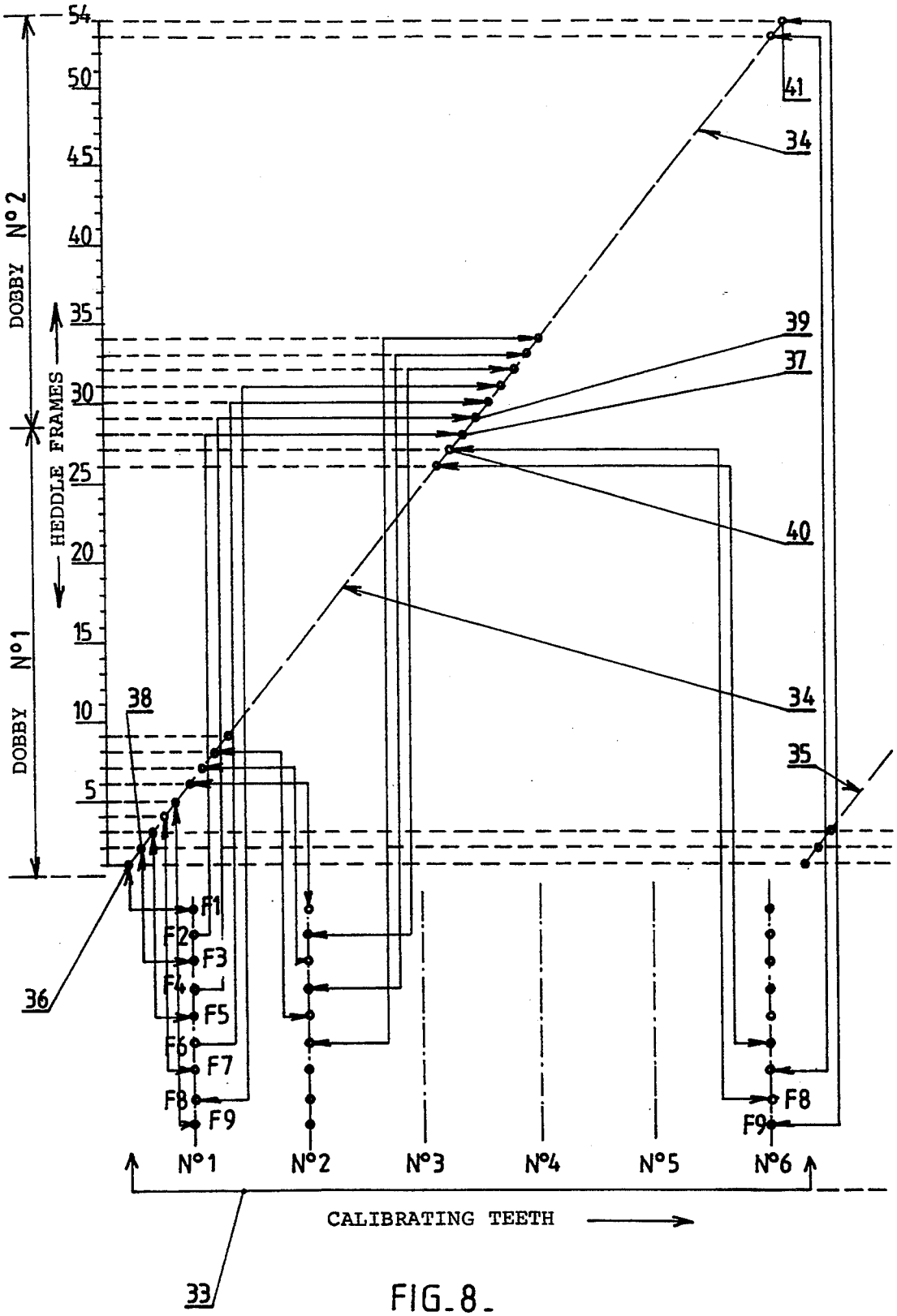
FIG. 8 is a diagram illustrating the heddling of the warp yarns on the weaving unit for a 2.5 D reinforcement with 19 layers.

FIG. 8 shows in accordance with the invention the heddling of the warp yarns of this 2.5 D 19-layer reinforcement.

The dobbies No 1 and 2 comprise 56 heddle frames, with 54 frames being able to be used for the actual weaving, the other two heddle frames being used for embodying the borders.

In the 2.5 D type reinforcement, the elementary pattern uses six consecutive teeth of the calibrating comb.

As each tooth of the calibrator 27 comprises nine yarns, six consecutive teeth of the calibrator contain 54 yarns corresponding to the 54 usable heddle frames.

FIG. 8 shows at 33 the first six teeth marked No 1 to 6 of the calibrator 27 and at 34 the alignment of row No 1 of the heddles 12 of the usable heddle frames (marked No 1 to 54) of the set of dobbies No 1 and 2. The alignment of row No. 2 of the heddles 12 of said heddle frames is shown partially at 35.

The superimposed yarns in the tooth No 1 of the series 33 are marked F1 to F9.

In accordance with the invention, the yarn F1 moves into the eye 36 of the heddle of row No. 1 of the heddle frame No 1 and the immediately adjacent yarn F2 moves into the eye 37 of the heddle of row No. 1 of heddle frame No. 28.

The yarn F3, immediately adjacent to the yarn F2, passes into the eye 38 of the heddle of row No. 1 of heddle frame No 2, but the next yarn F4 moves into the eye 39 of the heddle of row No. 1 of heddle frame No 29.

The process is the same for the yarns F5 to F9 and then for the homologous yarns of the teeth No 2 to No 6 of the series 33 so that the yarn F8 of the tooth No 6 moves into the eye 40 of the heddle of row No. 1 of the heddle frame No 27, whereas the yarn F9 of the tooth No 6 moves into the eye 41 of the heddle of row No. 1 of the final heddle frame No 54.

For the next set of six teeth of the calibrator, this same heddling is continued with, in this instance, the heddles of row No. 2 alignment 35) of the heddle frames of the dobbies No 1 and 2.

All the heddles of a given row are aligned obliquely and the lateral shift between the first heddle of the first heddle frame of the dobby No 1 and the first heddle of the final heddle frame of dobby No 2 corresponds to the length of the calibrating comb 27 occupied by the six teeth of the series 33.

Thus, during formation of the shed between two consecutive yarns of a given tooth of the calibrator, these two yarns shall move inside two vertical planes that form a slight angle. The angle is determined by the transverse shift of the weaving axis between the eyes of the heddles and is sufficient to prevent any tangling between the yarns.

It is also possible to carry out a different heddling to the extent that distribution of the yarns of a given calibrator tooth is effected on heddles having between them a sufficient lateral shift.

For example, so as to embody the 9-layered 2.5 D reinforcement, at least 24 heddle frames are needed. However with the heddling of the invention, a certain number of heddle frames of the dobby unit will function in tandem. That is, they will be lifted up or lowered together.

Although not essential, the advantage of using all the heddle frames resides in the optimal angular shift able to be obtained between the yarns of a given calibrating tooth.

Of course, instead of using the two conventional dobbies No 1 and 2, it is possible to use a special dobby comprising the number of desired heddle frames for embodying 2.5 D or 3 D reinforcements with 9, 11, 13, 15, 17, 19 and even more layers.

In such a dobby, the displacement of the various heddle frames ought to be adapted to the maximum shed it would be needed to obtain.

Finally, the invention is clearly not limited to the embodiment described above, but on the contrary covers all possible variants.

What is claimed is:

1. A process for weaving a thick woven reinforcement comprising a plurality of noncleaving layers having a structure comprising at least one member selected from the group consisting of 2.5 D and 3 D, and warp yarns interlacing weft yarns of at least two layers, said plurality of layers comprising a number of superimposed parallel planes of weft yarns, said process comprising the steps of:

moving said warp yarns successively into a yarn joining comb, a calibrating comb comprising a plurality of teeth, and a dobby weaving unit;

separating said warp yarns upstream of said calibrating comb into n superimposed laps, wherein $$n = \frac{N-1}{2},$$

and N, a positive odd integer, represents a number of layers of the reinforcement, and N-1/2 warp yarns pass into each of said teeth of said calibrating comb, and threading two adjacent warp yarns of said teeth into eyes of two heddles of a same row of two heddle frames, said two heddles of said same row are aligned along a vertical plane slanted with respect to an axis of said two adjacent warp yarns, and said two heddles are selected so that, during a formation of a shed, displacement planes of said two adjacent warp yarns form an angle sufficient to prevent said yarns from becoming caught up with one another.

2. The process according to claim 1, wherein, for a preestablished total number of available heddle frames in use, a number of heddles equals a product of said number of laps n and said number of teeth of said calibration comb, and wherein, for each set of teeth of said plurality of teeth, said yarns of each set of teeth are threaded onto the heddles of said same row of said heddle frames.

3. The process according to claim 2, wherein warp and weft yarns comprise a high strength fiber comprising at least one member selected from the group consisting of glass, silica, carbon, aramid, and ceramic.

4. The process according to claim 2, wherein said thick woven reinforcement comprises a plurality of noncleaving layers having a 3 D structure.

5. The process according to claim 2, wherein N is a positive integer of at least 9.

6. The process according to claim 5, wherein N is a positive integer of from 9 to 19.

7. The process according to claim 1, wherein said warp and weft yarns comprise a high strength fiber comprising at least one member selected from the group consisting of glass, silica, carbon, aramid, and ceramic.

8. The process according to claim 1, wherein said thick woven reinforcement comprises a plurality of noncleaving layers having a 3 D structure.

9. The process according to claim 1, wherein N is a positive integer of at least 9.

10. The process according to claim 9, wherein N is a positive integer of from 9 to 19.

11. A weaving machine for weaving a multilayer reinforcing fabric, comprising:

a creel for feeding said warp yarns a heddle frame containing heddles a yarn joining unit; and a weaving unit comprising a dobby system, a calibrating unit, and a traction system, said calibrating unit comprising a calibrating comb and a set of horizontal parallel separating bars, for distributing the warp yarns into a number of superimposed laps n wherein $$n = \frac{N-1}{2},$$

and N, a positive odd integer, represents a number of layers of the reinforcing fabric, said separating bars located upstream of said calibrating comb, and said calibrating unit further comprises a pair of horizontal support and guiding bars downstream of said calibrating comb.

12. A weaving machine according to claim 11, of teeth for the passage of warp yarns therethrough, wherein two adjacent warp yarns are adapted to be threaded into eyes of two heddles of a same row of two heddle frames aligned along a vertical wherein said calibrating comb comprises a plurality plane slanted with respect to an axis of said two adjacent warp yarns, and, during formation of a shed, said two heddles are selected so that displacement planes of said two adjacent warp yarns form an angle sufficient to prevent said yarns from becoming caught up with one another.

13. The weaving machine according to claim 12, wherein for a preestablished total number of available heddle frames in use, a number of heddles equals a product of said number of superimposed layers n and said number of teeth of said calibration comb, and wherein, for each set of said teeth, said yarns of said teeth are threaded into said heddles of said same row of said heddle frames.

14. The weaving machine according to claim 13, wherein said yarn joining unit comprises a yarn joining comb, and, upstream of said yarn joining comb, said set of horizontal parallel separating bars for separating said warp yarns into superimposed laps delivered by said creel, and, downstream of said yarn joining comb, said pair of horizontal support and guiding bars for supporting and guiding said warp yarns.

15. The weaving machine according to claim 14, wherein said dobby system comprises two dobbies comprising heddle frames in series side-by-side, controllable to function as a single dobby by being lifted and lowered together.

16. The weaving machine according to claim 11, wherein said yarn joining unit comprises a yarn joining comb, and, upstream of said yarn joining comb, said set of horizontal parallel separating bars for separating said warp yarns into superimposed laps delivered by said creel, and, downstream of said yarn joining comb, said pair of horizontal support and guiding bars for supporting and guiding said warp yarns.

17. The Weaving machine according to claim 16, wherein said dobby system comprises two dobbies comprising heddle frames in series side-by-side, controllable to function as a single dobby by means for tandem lifting and tandem lowering thereof.

18. The weaving machine according to claim 11, wherein said dobby system comprises two dobbies comprising heddle frames in series side-by-side, controllable to function as a single dobby by being lifted and lowered together.

* * * * *

UNITED STATES PATENT AND TRADEMARK OFFICE

CERTIFICATE OF CORRECTION

PATENT NO. : 5,353,844 
DATED : October 11, 1994
INVENTOR(S) : Francois MONGET et al.

It is certified that error appears in the above-indentified patent and that said Letters Patent is hereby corrected as shown below:

On the cover page, at section [73], change the assignee listed as "Societe Nationale Industrielle et Aerospatiale" to ---Aerospatiale Societe Nationale Industrielle---.

At column 1, line 26, change "and conveniently" to ---conveniently---.

At column 1, line 34, change "reinforcement" to ---"reinforcement"---.

At column 2, line 2, change "heddle, frames" to ---heddle frames---.

At column 2, line 15, change "layers, the" to ---layers. The---.

At column 2, line 15, change "layers defined" to ---layers is defined---.

At column 3, line 10, delete "and".

At column 3, line 23, change "frames" to ---frames 6---.

At column 3, line 25, change "all the yarns whose" to ---The---.

At column 3, line 37, change "a" (3rd occurrence) to —9—.

At column 7, line 37 (claim 12, line 1), insert ---wherein said calibrating comb comprises a plurality--- after "claim 11".

At column 7, line 41 (claim 12, line 5), delete "wherein said".

At column 7, line 42 (claim 12, line 6), delete "calibrating comb comprises a plurality".

UNITED STATES PATENT AND TRADEMARK OFFICE

CERTIFICATE OF CORRECTION

PATENT NO. : 5,353,844

DATED : October 11, 1994

INVENTOR(S) : Francois MONGET et al.

It is certified that error appears in the above-indentified patent and that said Letters Patent is hereby corrected as shown below:

At column 8, line 34 (claim 17, line 1), change "Weaving" to ---weaving---.

Signed and Sealed this

Seventh Day of February, 1995

*Attest:*

*Attesting Officer*

BRUCE LEHMAN

*Commissioner of Patents and Trademarks*